US007150540B2

(12) United States Patent
Kovacik et al.

(10) Patent No.: US 7,150,540 B2
(45) **Date of Patent: *Dec. 19, 2006**

(54) RECHARGEABLE LED UTILITY LIGHT

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co, Inc., Bedford Hts., OH (US)

( * ) Notice: Subject to any disclaimer, the term of this patent is extended or adjusted under 35 U.S.C. 154(b) by 112 days.

This patent is subject to a terminal disclaimer.

(21) Appl. No.: 10/915,527

(22) Filed: Aug. 10, 2004

(65) Prior Publication Data

US 2006/0034070 A1 Feb. 16, 2006

Related U.S. Application Data

(63) Continuation-in-part of application No. 29/210,107, filed on Jul. 26, 2004, now Pat. No. Des. 506,341.

(51) Int. Cl.
*F21V 5/00* (2006.01)

(52) U.S. Cl. ..... 362/245; 362/240; 362/244; 362/399; 362/800

(58) Field of Classification Search ..... 362/249, 362/252, 800, 244, 245, 183, 184, 102, 399, 362/362, 240, 241, 169, 268, 332
See application file for complete search history.

(56) References Cited

U.S. PATENT DOCUMENTS

| | | | | |
|---|---|---|---|---|
| 1,977,086 | A * | 10/1934 | Pryor | 362/208 |
| D135,092 | S | 2/1943 | Biller | |
| 4,262,327 | A | 4/1981 | Kovacik et al. | |
| 4,514,790 | A * | 4/1985 | Will | 362/183 |
| 4,733,335 | A * | 3/1988 | Serizawa et al. | 362/503 |
| 5,190,369 | A * | 3/1993 | Pace | 362/186 |
| 5,436,815 | A | 7/1995 | Grooms et al. | |
| 5,580,156 | A * | 12/1996 | Suzuki et al. | 362/184 |
| 5,642,932 | A * | 7/1997 | Matthews | 362/206 |
| 5,765,941 | A | 6/1998 | Vest | |
| 5,921,658 | A | 7/1999 | Kovacik et al. | |
| 5,996,865 | A * | 12/1999 | Bissey | 224/275 |
| D421,143 | S | 2/2000 | Kovacik et al. | |
| 6,176,592 | B1 | 1/2001 | Kovacik et al. | |
| 6,367,949 | B1 * | 4/2002 | Pederson | 362/240 |
| 6,485,160 | B1 * | 11/2002 | Sommers et al. | 362/184 |

(Continued)

FOREIGN PATENT DOCUMENTS

| | | |
|---|---|---|
| DE | 198 02 998 | 8/1998 |

(Continued)

OTHER PUBLICATIONS

Ferret Worklite AC, Jun. 4, 2002, www.ferretinstruments.com.

(Continued)

*Primary Examiner*—Renee Luebke
*Assistant Examiner*—Gunyoung T. Lee
(74) *Attorney, Agent, or Firm*—Butzel Long

(57) ABSTRACT

A portable utility light has a hollow housing formed of releasably joined front and rear housing halves with a lens opening. A plurality of LEDs is mounted in the housing adjacent the lens opening and positioned in rows and columns. A reflector member has a plurality of cone-shaped apertures each receiving one of the LEDs with a facing reflective surface. A transparent lens member is mounted in the lens opening to permit light generated from the LEDs to exit the housing.

16 Claims, 6 Drawing Sheets

U.S. PATENT DOCUMENTS

| | | | | |
|---|---|---|---|---|
| 6,534,926 | B1 | 3/2003 | Miller et al. | |
| D483,508 | S | 12/2003 | Galvez | |
| D483,893 | S | 12/2003 | Galvez | |
| 6,663,265 | B1 * | 12/2003 | Kovacik et al. | 362/375 |
| 6,722,771 | B1 * | 4/2004 | Stephens | 362/184 |
| 6,722,774 | B1 | 4/2004 | Kovacik et al. | |
| 6,729,518 | B1 * | 5/2004 | Badillo et al. | 224/578 |
| 6,840,653 | B1 * | 1/2005 | Galli | 362/240 |
| 6,840,654 | B1 * | 1/2005 | Guerrieri et al. | 362/241 |
| 2003/0039121 | A1 | 2/2003 | Nezigane | |
| 2003/0179572 | A1 | 9/2003 | Schnell | |
| 2005/0276045 | A1 * | 12/2005 | Kovacik et al. | 362/247 |
| 2006/0034078 | A1 * | 2/2006 | Kovacik et al. | 362/227 |
| 2006/0034091 | A1 * | 2/2006 | Kovacik et al. | 362/398 |

FOREIGN PATENT DOCUMENTS

| | | |
|---|---|---|
| DE | 203 17 017 | 3/2004 |
| WO | WO 02/03761 | 1/2002 |

OTHER PUBLICATIONS

Bayco SL-2105, Bay SL-2106, Apr. 1, 2003, www.budgetlighting.com.

* cited by examiner

RECHARGEABLE LED UTILITY LIGHT

This application is a continuation-in-part of the U.S. design patent application ser. No. 29/210,107 filed, Jul. 26, 2004 now U.S. Pat. No. D. 506,341.

BACKGROUND OF THE INVENTION

The present invention relates generally to illumination devices and, in particular, to an LED utility light.

Portable lights, which can be manually moved and suspended about a work site to aid a user to obtain the best lighting conditions, are well known. It has been the practice to use incandescent light bulbs, suitably encased in light guards, for this purpose. Such lights are often referred to as trouble lamps, extension lights, work lights, inspection lights, utility lights, and the like, and are commonly employed by mechanics and other workers who require a concentration of light while frequently changing locations. Such a trouble light is shown in the U.S. Pat. No. 4,774,647 to Kovacik et al. Fluorescent lights have several advantages in use as compared with the incandescent bulbs. As an example, for the same wattage fluorescent lights usually provide more light with less glare. In the past, attempts have been made to convert portable lights such as extension lights to fluorescent tubes.

Light emitting diodes (LEDs) are well known for providing illumination to digital displays and the like. It has become more common for a concentration of LEDs to be utilized for providing illumination. LEDs are particularly advantageous because of their low power consumption per candlepower produced when compared to incandescent light bulbs and, to a lesser degree, to fluorescent light bulbs.

The art continues to seek improvements. It is desirable to provide a portable light having lower power consumption that also provides sufficient illumination for a work site. It is also desirable to be able to place and orient the portable light in as many locations and positions as possible. It is further desirable to provide a utility light that does not always require the use of an external power supply cord. It is always desirable to provide utility lamps that are lightweight and cost-effective to produce.

SUMMARY OF THE INVENTION

The present invention concerns a portable utility light including: a hollow housing having a lens opening formed therein; a plurality of LEDs disposed in the hollow housing adjacent the lens opening; a reflector member disposed in the housing and having a plurality of apertures of cone-shaped profile formed therein, each of the apertures receiving an associated one of the LEDs; and a transparent lens member mounted in the lens opening permitting light generated from the LEDs to exit the housing. The housing is formed by a front housing half releasably attached to a rear housing half and is generally arcuate in a horizontal plane.

The LEDs are mounted on a circuit board in rows and columns. The reflector member has a reflective surface facing the lens member. The light includes a battery disposed in the housing and connected to the LEDs by a switch. An electrical plug is mounted to the housing and connected to the battery for connection to an external power source to recharge the battery. The battery is a DC battery and a transformer means is connected to the battery for recharging.

A hook member is disposed in a recess formed in an exterior surface of the housing and is rotatable between a stored position in the recess and an extended position. The hook member is attached to the housing by a ball and socket connection permitting the hook member to rotate about a longitudinal axis of the hook member.

A lanyard can be attached to the housing. A pair of handle cushions is attached to opposite sides of the housing. A carrying case is provided for receiving and retaining the light.

The lens member has a plurality of focusing portions formed thereon facing the LEDs for focusing light generated by said LEDs. In the alternative, the lens member can be flat or have concave portions for generating a flood light effect.

The LED utility light in accordance with the present invention advantageously provides a portable handheld utility light that does not need to be connected constantly to an external power supply and may be placed and oriented in many locations and positions with the use of the hook member.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
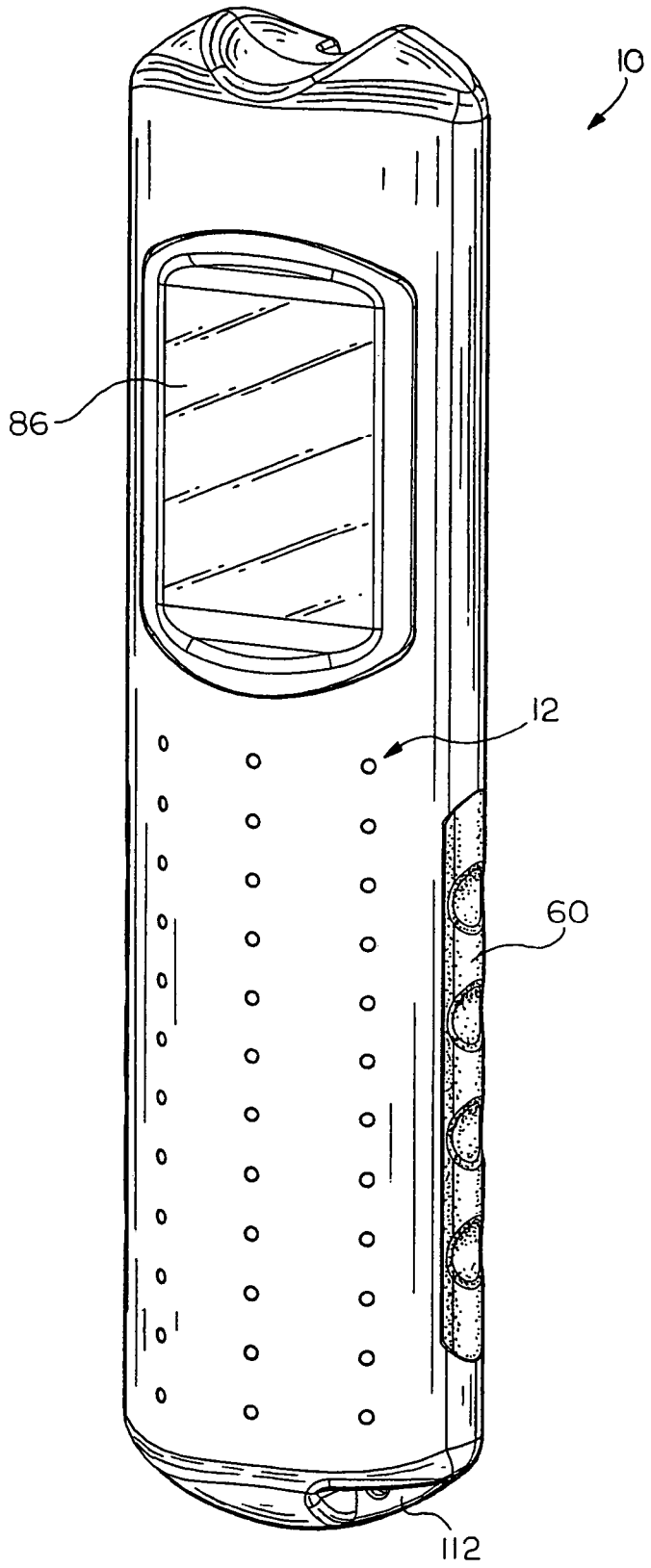
FIG. 1 is a perspective view of an LED utility light in accordance with the present invention.
Figure 2:
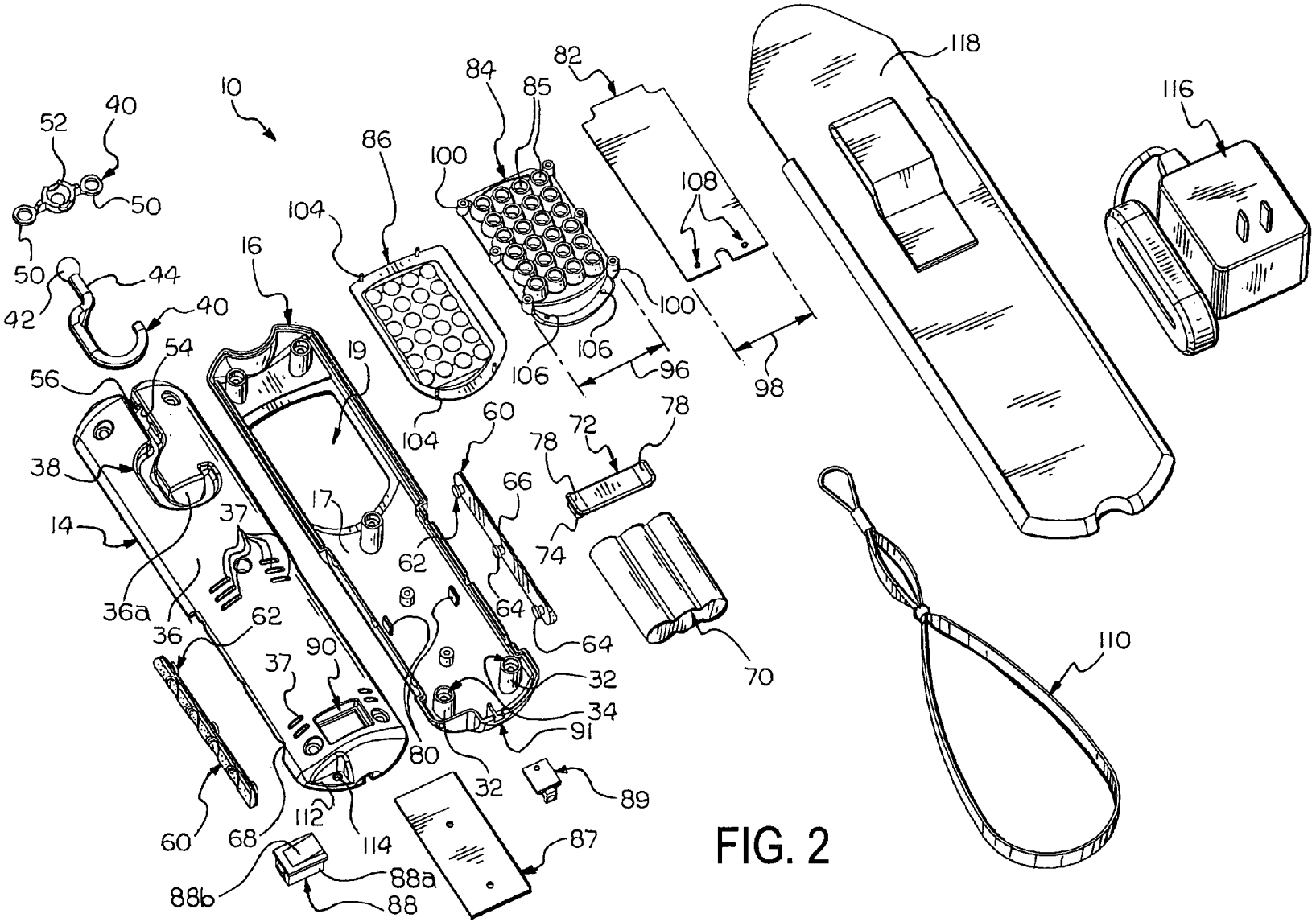
FIG. 2 is an exploded perspective view of the utility light shown in FIG. 1.
Figure 3:
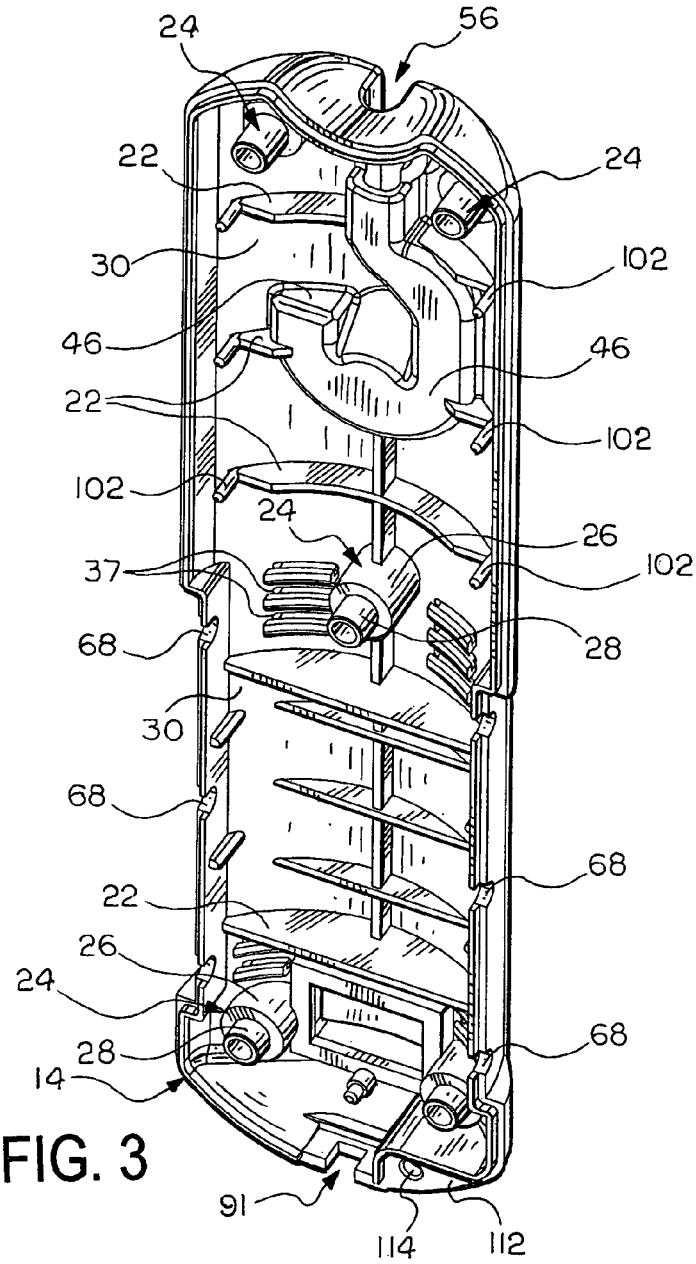
FIG. 3 is a perspective view of the rear housing half shown in FIG. 2.
Figure 4:
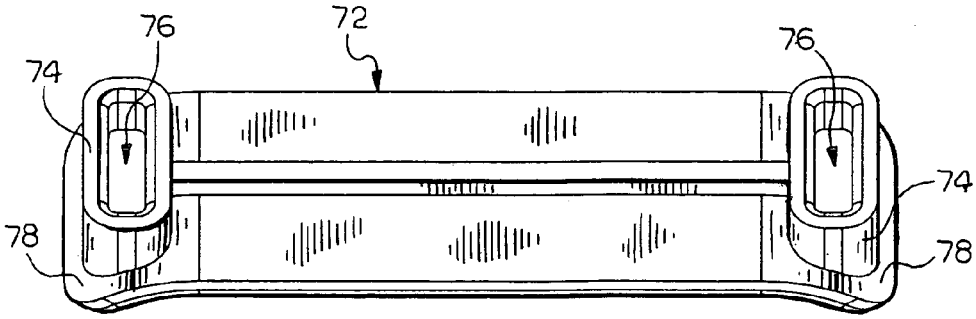
FIG. 4 is a perspective view of the battery retainer shown in FIG. 2.

Referring now to FIGS. 1–4, a rechargeable LED utility light in accordance with the present invention is indicated generally at 10. The utility light 10 includes a horizontally split hollow light housing 12 formed with a rear housing half 14 and a front housing half 16. When attached, the housing halves 14 and 16 define an upper light portion 18 extending from a hollow lower handle portion 20. The front housing half 16 has a lens opening 19 formed in the upper light portion 18. The housing halves 14 and 16 are substantially arcuate in cross section to form the housing 12 with a substantially oval cross section (see FIG. 7). The housing 12 is preferably formed of a lightweight material, such as plastic or the like, as the utility light 10 is contemplated to be both handheld and portable. The rear housing half 14 includes a plurality of strengthening ribs 22 extending across interior walls thereof. A plurality of bosses 24 having a larger diameter portion 26 and a smaller diameter portion 28 extend from an inner surface 30 of the rear housing half 14 for receiving respective fasteners (not shown). The fasteners extend through the bosses 24 from corresponding posts 32 formed in and extending inwardly from an interior surface 17 of the front housing half 16 to secure the halves 14 and 16 together to form the housing 12, discussed in more detail below. During assembly, the smaller diameter portion 28 of each of the bosses 24 is received by a corresponding aperture 34 formed in an associated one of the posts 32 of the front housing half 16.

An exterior surface 36 of the light portion 18 of the rear housing half 14 is formed to define a recess 38 for receiving and storing a hook member 40 therein. The hook member 40 includes a ball portion 42 that is connected to a shank portion 44. The recess 38 has closed bottom wall 46 at the interior surface 30 of the rear housing half 14, best seen in FIG. 2. The wall 46 interrupts at least a portion of two of the strengthening ribs 22. The shape of the recess 38 corresponds to the shape of the hook member 40 in plan view. When the hook member 40 is disposed in the recess 38, the hook member 40 does not extend above the exterior surface 36 of the rear housing half 14. Adjacent a lower portion of the recess 38 is a sloped surface 36*a* of the exterior surface 36 that provides access to the hook member 40 for improved removal and stowage for the hook member 40. A plurality of elongated vent openings 37 are formed in the wall of the rear housing half 14, which provide a flow of cooling air for the electric components disposed in the light housing 12, discussed in more detail below.

Figure 6:
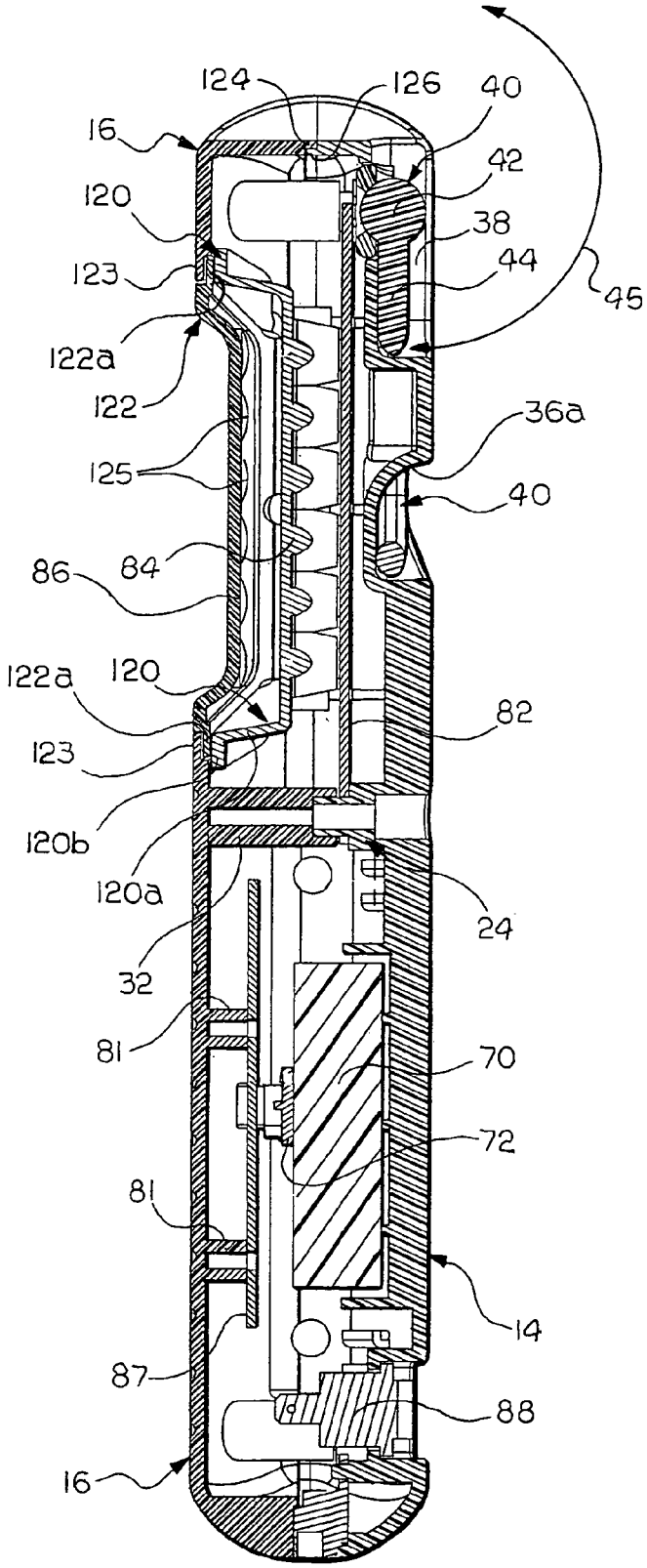
FIG. 6 is a cross-sectional view taken along the line 6—6 in FIG. 5.

The ball portion 42 of the hook member 40 cooperates with a hook ball retainer 48 disposed between the housing halves 14 and 16 when the housing 12 is assembled. The hook ball retainer 48 includes a pair of fastener receivers 50 extending from opposing sides of a ball receiver 52. The fastener receivers 50 are placed between an upper pair of mating bosses 24 and posts 32 of the light portion 18. The ball receiver 52, in conjunction with a curved surface 54 defining an upper aperture 56 in the rear housing half 14, receive the ball portion 42 of the hook member 40. After the ball portion 40 is snap fit into the aperture 56, the ball portion 40, the ball receiver 52 and the curved surface 54 function as a ball and socket connection. As shown in FIG. 6, this connection allows the hook member 40 to rotate between the stored position to an extended position as indicated by an arrow 45. Once out of the recess 38, the hook member 40 is free to rotate about its longitudinal axis. The hook member 40, therefore, provides a means for placing and orienting the utility light 10 during use.

Each of a pair of elongated handle cushions 60 includes a plurality of attachment fingers 62 having a stop portion 64 and a shaft portion 66. The handle cushions 60 are each attached to the handle portion 20 of the housing 12 by placing the shaft portion 66 of the attachment fingers 62 in corresponding grooves 68 formed between the rear half 14 and the upper half 16 of the housing 12. The stop portions 64 prevent accidental removal of the cushions 60 from the housing 12 after the housing 12 has been assembled. The handle cushions 60 are each preferably constructed of a soft, easily deflectable material.

A battery 70 is disposed in a recess formed between the rear half 14 and the front half 16 of the handle portion 20. The battery 70 is preferably a rechargeable battery, such as a nickel metal hydride battery or similar rechargeable-type battery. The battery 70 is maintained in its position in the recess by a battery retainer 72 (see FIG. 4) disposed on an upper surface thereof. The battery retainer 72 includes a pair of legs 74 each extending downwardly from opposing ends thereof and defining an aperture 76 therein, and a pair of wing portions 78 extending upwardly from the opposing ends. The apertures 76 of the legs 74 each receive a free end of a post 80 extending upwardly from the interior surface 17 of the front housing half 16. The wing portions 78 extend beyond the outer edges of the battery 70 to provide additional support for the battery 70 when the utility light 10 is assembled.

The hollow housing 12 defines a space between the rear half 14 and the front half 16 thereof for receiving a plurality of electrical lighting components, including an LED circuit board assembly 82, a reflector member 84, a lens member 86, and a switch 88. The switch 88 is disposed in an aperture 90 formed in the rear half 14 of the housing 12 and electrically connects power from the battery 70 to the LED circuit board assembly 82. No power converter for the circuit board assembly 82 is necessary since the battery 70 is a DC power source, advantageously reducing the size and weight of the utility light 10. The LED circuit board assembly 82 includes a plurality of LEDs 92, best seen in FIGS. 6 and 7, extending from an upper surface 94 thereof. The LEDs 92 are operable to emit light in a well-known manner when electrical power is connected from the battery 70 to the circuit board assembly 82 through the switch 88. A plug circuit board 87 is disposed between the rear half 14 and the front half 16 of the housing 12 and electrically connects a pin-type electrical plug 89 and the battery 70. The plug circuit board 87 is preferably attached to a pair of posts 81 extending upwardly from the interior surface 17 of the front housing half 16. The plug 89 is disposed in an aperture 91 formed between the rear half 14 and the front half 16 of the housing 12.

The reflector member 84 is fit over the front surface of the LED circuit board assembly 82. The reflector member 84 includes a plurality of spaced apart through apertures 85. The front surface of the reflector member 84 is preferably mirror chrome plated or has a similar highly reflective surface. The number of apertures 85 corresponds to the number of LEDs 92 on the circuit board assembly 82. The walls of the reflector member 84 that define each of the apertures 85 are also mirror chrome plated and taper radially outwardly from the rear surface of the reflector member 84 to the front surface of the reflector member 84 to form a generally cone-shape profile, best seen in FIG. 6. A width, indicated by an arrow 96 in FIG. 2, of the reflector member 84 is greater than a width, indicated by an arrow 98, of the circuit board assembly 82. A plurality of support legs 100 is formed on the periphery of the reflector member 84. The support legs 100 extend rearwardly from the rear surface of the reflector member 84 and, because the width 96 is greater than the width 98, when the reflector member 84 is placed over the circuit board assembly 82 the support legs extend beyond the periphery of the circuit board assembly 82 and rearwardly of the rear surface of the circuit board assembly 82. The support legs 100 engage with corresponding support pins 102 extending inwardly from outer edges of the support ribs 22 of the lower housing half 14. A flange 120 extends from opposed upper and lower ends of the reflector member 84. The flange 120 has an upwardly extending portion 120*a* and an outwardly extending portion 120*b*, best seen in FIG. 6.

The lens member 86 is received in the lens opening 19 extending through the upper portion of the front housing half 16 during assembly of the utility light 10. The lens member 86 is preferably constructed of clear plastic material or similar material. The lens member 86 includes a plurality of posts 104 extending rearwardly therefrom that cooperate with apertures 106 formed in the reflector member 84 and with apertures 108 formed in the circuit board assembly 82 during assembly of the utility light 10. The lens member 86 includes a flange 122 extending from opposed upper and lower ends thereof. The flange 122 includes a stepped portion 122*a*, best seen in FIG. 6. A flange 123 extends from opposed ends of the front housing half 16 that define the aperture 102, best seen in FIG. 6, for cooperating with the stepped portions 122*a* during assembly of the utility light 10.

Figure 7:
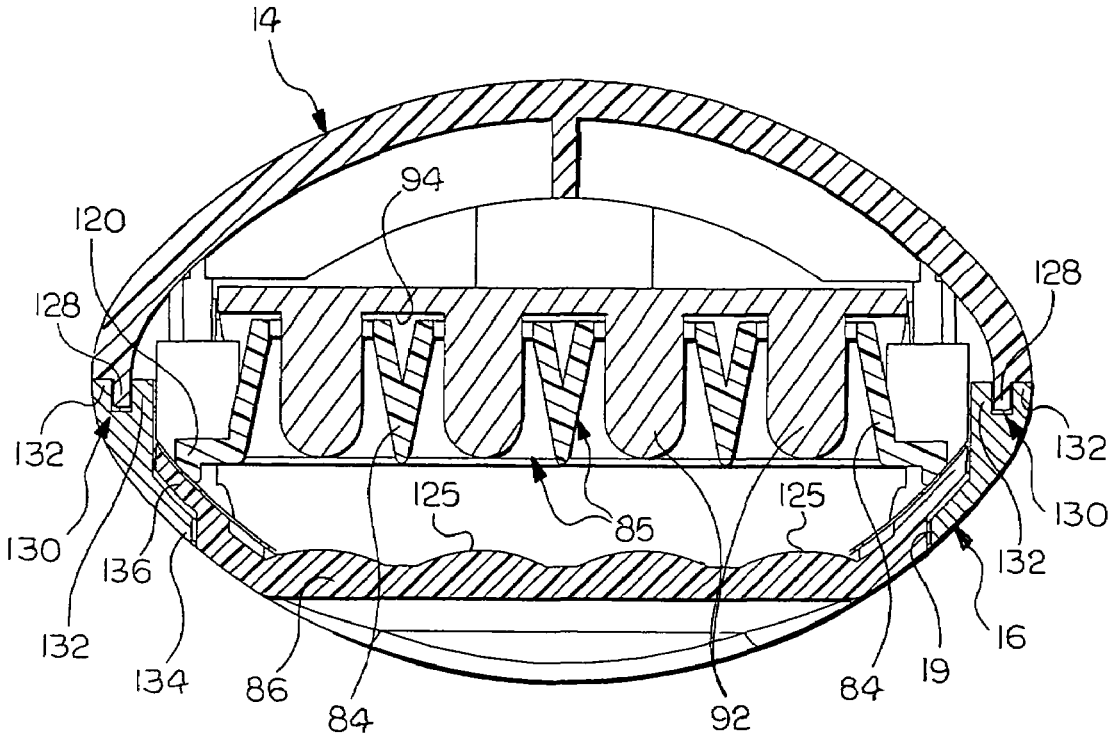
FIG. 7 is a cross-sectional view taken along the line 7—7 in FIG. 5.

As seen in FIGS. 6 and 7, the lens member 86 has a plurality of focusing portions 125 that correspond in number and position to the LEDs 92. Each of the focusing portions 125 is formed as a convex protrusion on the rear surface of the lens member 86 facing the reflector member 84. The focusing portions 125 collect and focus light from the corresponding LEDs 92 to generate a collective focused beam of light exiting the lens member 86. However, the rear surface of the lens member 86 could be flat, so that no focusing is provided, or the areas adjacent the LEDs 92 could be formed with concave shapes, so that the light exiting the lens member 86 is dispersed for a flood light effect.

A lanyard 110 is preferably provided for routing through a hole 114 formed in a flange 112 on a lower portion of the rear housing half 14. An A/C transformer means 116 is preferably provided for attachment to the electrical plug 89 for recharging the battery 70. The transformer means 116 connects to a source of standard AC power "120 V", reduces it to a lower voltage and converts to DC power to operate the LEDs 92. A carrying case 118 is preferably provided for attachment to a belt loop or the like (not shown) for ease of portability of the utility light 10.

Figure 5:
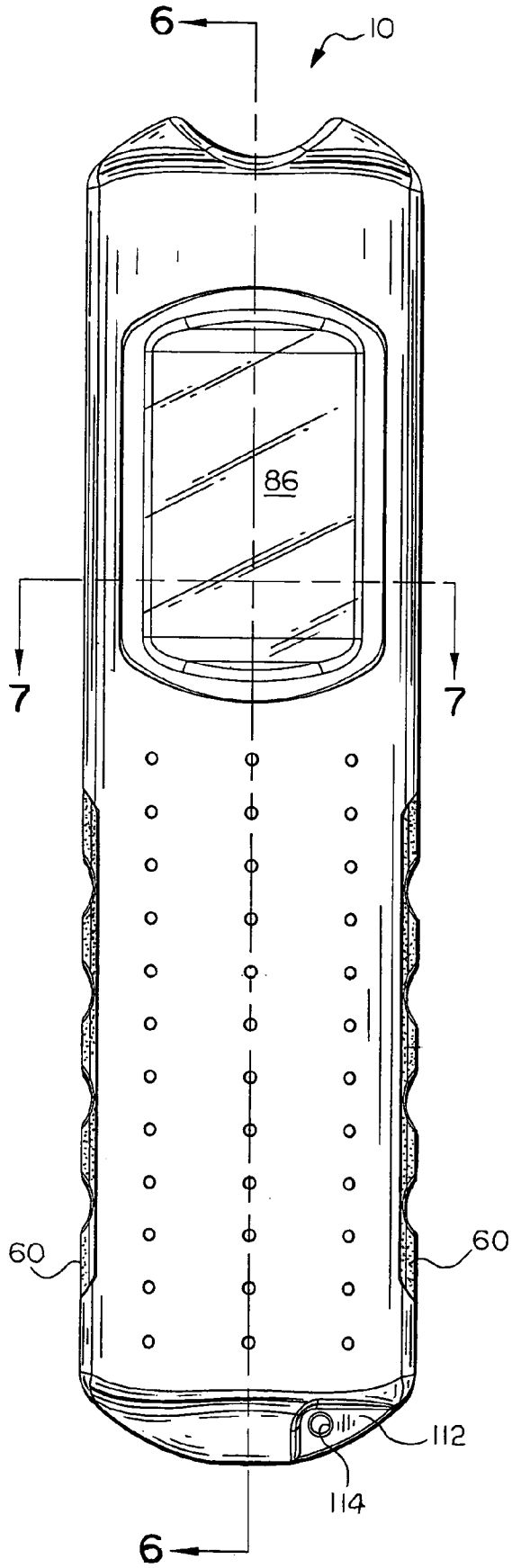
FIG. 5 is a front elevation view of the utility light shown in FIG. 1.

During assembly of the utility light 10, the hook member 40 and the handle cushions 60 are placed in their respective mounting locations. The switch 88 is placed in the aperture 90, the reflector member 84 is fit over the upper surface 94 of the LED circuit board assembly 82 (placing the LEDs 92 in the respective apertures 85 of the reflector member 84), and the support legs 100 are placed on the support pins 102. The battery retainer 72 is placed on the posts 80 and the battery 70 is placed on the battery retainer 72. The lens member 86 is placed in the aperture 102, and the stepped portion 122*a* engages with the flange 123 of the upper housing half 16 to retain the lens member 86 in the aperture 102. Alternatively, the lens member 86 is placed on the reflector 84 with the stepped portion 122*a* resting on the outwardly extending portion 120*b*. The upper housing half 16 is placed on the lower housing half 14, and a flange 124 on the outer edge of the upper housing half 16 overlaps a corresponding flange 126 on the outer edge of the lower housing half 14, best seen in FIG. 5, and the respective bosses 24 are received and engaged in corresponding posts 32, best seen in FIG. 5. When the halves 14 and 16 are joined, a tongue 128 extending from a rear edge of the housing half 14 cooperates with a groove 130 formed between a pair of flanges 132 extending from a rear edge of the housing half 16, best seen in FIG. 7, to provide ease of alignment of the split halves 14 and 16 during assembly of the light housing 12. A flange 134 on the outer edge of the upper housing half 16 overlaps a corresponding flange 136 on the outer edge of the lens member 86, best seen in FIG. 7. Fasteners such as screws (not shown) or the like are then placed in each of the engaging bosses 24 and posts 32 and the housing halves 14 and 16 are secured together to form the housing 12.

The switch 88 includes a switch housing 88*a* with a pair of electrical terminals (not shown) extending from a lower surface thereof and a switch rocker 88*b* on an upper surface. One of the terminals is connected to the battery 70 through the circuit board 87 and the other of the terminals is connected to the LED circuit board assembly 82. The switch rocker in the on and off positions alternately provides power from the battery 70 to the LED circuit board assembly 82. The switch 76 is easily actuated by a thumb or finger of a person (not shown) holding the handle portion 20 to light the LEDs 92 of the circuit board assembly 82 with one hand while also orienting and hanging the light 10 with the same hand.

Figure 8:
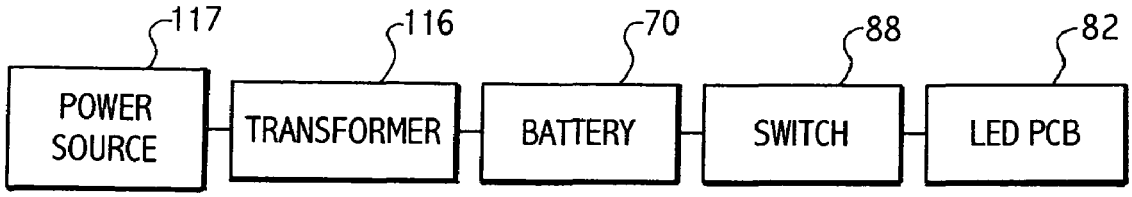
FIG. 8 is an electrical schematic of the utility light shown in FIG. 1.

An electrical schematic of the utility light 10 is shown in FIG. 8. The A/C transformer 116 is provided for a charging connection from an external power source 117 through the transformer 116 to the battery 70. The electrical power from the battery 70 is directed through the switch 88 to the LED circuit board assembly 82.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A portable utility light, comprising:

a hollow housing having a lens opening formed therein, said housing having at least one handle cushion and being split along a longitudinal axis with a front housing half releasably attached to a rear housing half, said lens opening facing transverse to said longitudinal axis;

a plurality of LEDs mounted in said hollow housing adjacent said lens opening;

a reflector member mounted in said housing and having a plurality of apertures of cone-shaped profile formed therein, each of said apertures receiving an associated one of said LEDs; and a transparent lens member mounted in said lens opening permitting light generated from said LEDs to exit said housing, said lens member including a plurality of focusing portions formed thereon facing said LEDs for focusing light generated by said LEDs; wherein each focusing portion is a convex lens protruding inwardly, toward a single corresponding LED.

2. The light according to claim 1 wherein said housing is generally arcuate in a horizontal plane.

3. The light according to claim 1 wherein said LEDs are mounted on a circuit board in rows and columns.

4. The light according to claim 1 wherein said reflector member has a reflective surface facing said lens member.

5. The light according to claim 1 including a battery disposed in said housing and connected to said LEDs by a switch.

6. The light according to claim 5 including an electrical plug mounted to said housing and connected to said battery, said electrical plug being adapted to connect to an external power source to recharge said battery.

7. The light according to claim 5 wherein said battery is a DC battery and including a transformer means connected to said battery for recharging said battery.

8. The light according to claim 1 including a hook member disposed in a recess formed in an exterior surface of said housing and being rotatable between a stored position in said recess and an extended position.

9. The light according to claim 8 wherein said hook member is attached to said housing by a ball and socket connection permitting said hook member to rotate about a longitudinal axis of said hook member.

10. The light according to claim 1 including a lanyard attached to said housing.

11. The light according to claim 1 including a carrying case for receiving and retaining said housing.

12. A portable utility light, comprising;

a hollow housing having a lens opening formed therein, said lens opening facing transverse to a longitudinal axis of said light housing, said housing having at least one handle cushion and being split along said longitudinal axis into a front housing half releasably attached to a rear housing half;

a plurality of LEDs mounted in said hollow housing adjacent said lens opening;

a battery mounted in said housing and electrically connected in operate said LEDs;

a reflector member mounted in said housing and having a plurality of apertures of cone-shaped profile formed therein, each of said apertures receiving an associated one of said LEDs; and a transparent lens member mounted in said lens opening permitting light generated from said LEDs to exit said housing. said lens member including a plurality of focusing portions formed thereon facing said LEDs for focusing light generated by said LEDs; wherein each focusing portion is a convex lens protruding inwardly, toward a single corresponding LED.

13. The light according to claim 12 wherein said battery is connected to said LEDs by a switch and including an electrical plug mounted to said housing and connected to said battery, said electrical plug being adapted to connect to an external power source to recharge said battery.

14. A portable utility light, comprising:

a hollow housing having a lens opening formed therein, said lens opening facing transverse to a longitudinal axis of said light housing, said housing being split along said longitudinal axis into a front housing half releasably attached to a rear housing half;

a pair of handle cushions attached to opposite sides of said housing a plurality of LEDs mounted in said hollow housing adjacent said lens opening;

a reflector member mounted in said housing and having a plurality of apertures of cone-shaped profile formed therein, each of said apertures receiving an associated one of said LEDs; and a transparent lens member mounted in said lens opening permitting light generated from said LEDs to exit said housing. said lens member including a plurality of focusing portions formed thereon facing said LEDs for focusing light generated by said LEDs; wherein each focusing portion is a convex lens protruding inwardly, toward a single corresponding LED.

15. The light according to claim 14 including a battery disposed in said housing and connected to said LEDs by a switch, and an electrical plug mounted to said housing and connected to said battery, said electrical plug being adapted to connect to an external power source to recharge said battery.

16. The light according to claim 14 wherein said LEDs are mounted on a circuit board In rows and columns.

* * * * *